United States Patent [19]

Paradowski et al.

[11] Patent Number: 4,539,028

[45] Date of Patent: Sep. 3, 1985

[54] METHOD AND APPARATUS FOR COOLING AND LIQUEFYING AT LEAST ONE GAS WITH A LOW BOILING POINT, SUCH AS FOR EXAMPLE NATURAL GAS

[75] Inventors: Henri Paradowski, Cergy Pontoise; Didier Leroux, Courbevoie, both of France

[73] Assignee: Compagnie Francaise D'Etudes et de Construction "Technip", Paris, France

[21] Appl. No.: 604,049

[22] Filed: Apr. 26, 1984

[30] Foreign Application Priority Data

May 6, 1983 [FR] France ..... 83 07620

[51] Int. Cl.[3] ..... F25J 1/02

[52] U.S. Cl. ..... 62/9; 62/40; 62/335

[58] Field of Search ..... 62/40, 9, 11, 335

[56] References Cited

U.S. PATENT DOCUMENTS 4,274,849 6/1981 Garier et al. ..... 62/40

*Primary Examiner*—Frank Sever

*Attorney, Agent, or Firm*—Kenyon & Kenyon

[57] ABSTRACT

The present invention relates to a method and an apparatus for liquefying a gas with a low boiling point, such as natural gas, by heat exchange with a main refrigerant fluid having several components. The whole of the vapor phase of this main refrigerant fluid, after being condensed and subcooled, is expanded at once to at least one first pressure, and the whole of the liquid phase of the subcooled main refrigerant fluid is expanded at once to at least one second pressure, different from the said first pressure.

21 Claims, 6 Drawing Figures

METHOD AND APPARATUS FOR COOLING AND LIQUEFYING AT LEAST ONE GAS WITH A LOW BOILING POINT, SUCH AS FOR EXAMPLE NATURAL GAS

The present invention has for a subject matter a method and an apparatus for cooling and liquefying at least one gas with a low boiling point, such as for example natural gas, or, possibly, any gas mixture including at least one component with a low boiling point.

There are already known methods of liquefaction of for example natural gas, in which the natural gas is gradually liquefied by successive heat exchanges with several refrigerating fluids with decreasing boiling points. This so-called "cascade" liquefying method requires the use of a large number of exchangers, compressors, pumps, etc, allowing closed-circuit circulation of each of the refrigerating fluids. The installation therefore is complex and the multiplicity of the equipment reduces the reliability of the whole. Moreover, the cooling curves of these refrigerating fluids do not follow the continuous trends of the cooling curve of natural gas, thus resulting in reduced efficiencies and, therefore, important losses of energy.

There are also known methods of liquefaction of natural gas by heat exchange with a refrigerating fluid with several components subjected to at least one partial condensation, the condensed portion of the said refrigerating fluid ensuring by heat exchange the liquefaction of the natural gas. The condensed portion or portions of the said refrigerating fluid also constitute a refrigerating fluid with several components. The cooling curve of the refrigerating fluid with several components is, in this case, similar to the cooling curve of natural gas. Moreover, the installation is simplified, requiring only one (complex) refrigerating fluid in the installation.

It is also known to make use of an auxiliary refrigerating fluid with one or several components for precooling simultaneously or separately the natural gas to be liquefied and the main refrigerating fluid. The auxiliary and main refrigerating fluids, each in closed-circuit circulation, are each compressed by a separate compressor set.

These methods employing refrigerating fluids with several components use exchangers of the coiled type to obtain a good efficiency and more particularly a correct homogeneity of the liquid-vapour mixture at the time of its distribution at the head of the exchanger during its vapourization along the exchanger. Unfortunately, such exchangers remain expensive, bulky and heavy apparatus.

The present invention therefore has as a purpose to avoid the aforementioned disadvantages of the methods of the prior art, by providing a method for cooling and liquefying for example natural gas, allowing particularly the efficiency to be improved while at the same time reducing costs.

To this end, the present invention has for a subject matter a method for cooling and liquefying at least one gas with a low boiling point, such as for example natural gas, by heat exchange with at least a portion of a precooled main refrigerant fluid with several components until its at least partial liquefaction by thermal exchange with an auxiliary refrigerant fluid, particularly with several components, the said refrigerant fluids forming part of an incorporated frigorific cascade of at least these two refrigerant fluids, the said main refrigerant fluid flowing according to a closed-circuit cooling cycle and undergoing therein successively: at least one compression in the gaseous state, at least one preliminary cooling with at least partial condensation, particularly by thermal exchange with the said auxiliary refrigerant fluid, the liquid and vapour phases thus obtained being thereafter separated, at least one refrigeration with total liquefaction followed by subcooling, and an expansion for subsequent heat exchange and resulting vaporization, in countercurrent relationship with itself and with the said gas for at least partial liquefaction of the latter, the vapour thus heated being finally recompressed and recycled, characterized in that the said vapour phase of the condensed and subsooled main refrigerant fluid is expanded, in one time, to at least one first pressure, and in that the said liquid phase of the subcooled main refrigerant fluid is expanded, in one time, to at least one second pressure, different from the said first pressure.

According to another feature of the invention, a first portion of the said condensed and subcooled vapour phase of the main refrigerating fluid is expanded to a first pressure, a second portion being expanded to a second pressure; and a first portion of the said subcooled liquid phase of the main refrigerant fluid is expanded to the said first pressure, a second portion being expanded to the said second pressure.

According to another feature of the invention, after the said vaporization, the said first portions of the said vapour and liquid phases are mixed and the said second portions of the said vapour and liquid phases are mixed.

According to still another feature of the invention, after the said expansion, and before the said vaporization, the said first portions of the said vapour and liquid phases are mixed, and the said second portions of the said vapour and liquid phases are mixed.

According to another feature of the invention, the vapour and liquid phases of the main refrigerant fluid obtained after the said expansion are separated prior to heat exchange with the said gas to be liquefied and the main refrigerant fluid before expansion.

According to another feature of the invention, the said first pressure is a low pressure, lower than about one bar above atmospheric and the said second pressure is a medium pressure ranging from about 1.5 to about 3 bars above atmospheric.

According to another feature of the invention, at least a portion of the said gas to be liquefied is precooled by heat exchange with at least a portion of the said auxiliary refrigerant fluid.

According to another feature of the invention, at least a portion of the said gas to be liquefied is precooled by heat exchange with at least a portion of the said heated vapour at the said first or the said second pressure.

According to still another feature of the invention, at least a portion of the said main refrigerant fluid is precooled by heat exchange with at least a portion of the said heated vapour at the said first or the said second pressure.

According to another feature of the invention, the said auxiliary refrigerant fluid flowing according to a closed-circuit cooling cycle and undergoing therein successively: at least one compression in the gaseous state; at least one preliminary cooling with, possibly, an at least partial condensation by thermal exchange with a cooling agent preferably of external origin; at least one self-refrigeration with total liquefaction followed by subcooling and expansion for subsequent heat exchange and resulting concomitant vaporization in countercurrent relationship with itself before its expansion and with the main refrigerant fluid, and possibly the gas to be liquefied; the vapour thus heated being recycled and recompressed, the expansion of the auxiliary refrigerant fluid, prior to vaporization, takes place at at least two pressure levels, particularly three pressure levels.

According to another feature of the invention, the vapour and liquid phases of the auxiliary refrigerant fluid after expansion are separated.

According to other features of the invention, the said main refrigerant fluid has the following molar composition:

nitrogen $N_2$: 0% to 2%
methane $CH_4$: 35% to 55%
ethylene $C_2H_4$ or ethane $C_2H_6$: 28% to 65%
propylene $C_3H_6$, propane $C_3H_8$: 0% to 15% and the said auxiliary refrigerant fluid has the following molar composition:

ethylene $C_2H_4$ or ethane $C_2H_6$: 30% to 70%
propylene $C_3H_6$ or propane $C_3H_8$: 70% to 30%

The present invention also has for a subject matter an apparatus for carrying out the aforementioned method, of the type including at least the following circuits: an open circuit of gas to be liquefied; a closed circuit of main refrigerant fluid in heat exchange relationship with the said gas circuit by means of at least one cryogenic heat-exchanger, and forming part of an incorporated frigorific cascade of at least two refrigerant fluids, namely, a main fluid and an auxiliary fluid, respectively; a closed circuit of auxiliary refrigerant fluid in heat exchange relationship with the said main refrigerant fluid circuit and possibly with the said circuit of gas to be liquefied, by means of at least one cryogenic heat-exchanger for precooling and at least partial liquefaction of the said main refrigerant fluid; the said closed circuit of main refrigerant fluid including successively: at least one compressor and possibly one heat exchanger or cooler connected to a path of flow of the main refrigerant fluid passing through the said cryogenic exchanger of the auxiliary refrigerant fluid, a separator of the vapour and liquid phases thus obtained, the said cryogenic heat-exchanger and an expansion system, including an expansion member in the path of flow of each fraction of main refrigerant fluid, connected to the said compressor, and characterized in that the said cryogenic heat-exchanger of the said circuit of main refrigerant fluid is a plate exchanger provided with different passage paths for each of the fluids present during the heat exchange, namely, the gas to be liquified, the liquid and vapour phases or fractions of the partially condensed main refrigerant fluid, as well as the fractions, derived therefrom, expanded to different pressure levels.

According to another feature of the invention, the location of each element of the said expansion system with respect to the said cryogenic heat-exchanger of the circuit of main refrigerant fluid is modifiable for each said fraction of the main refrigerant fluid.

According to another feature of the invention, a separator of the vapour and liquid phases is provided, downstream of the said expansion member, in the path of flow of the vapour fraction of the main refrigerant fluid.

According to another feature of the invention, a heat exchanger is provided upstream of the said cryogenic heat exchanger of the main refrigerant fluid circuit, which heat exchanger is traversed, e.g. in countercurrent relationship, on the one hand by the main refrigerant fluid vaporized after expansion in the said cryogenic heat-exchanger and, on the other hand, by at least a portion of the gas to be liquefied and/or the main refrigerant fluid.

According to another feature of the invention, the said circuit of gas to be liquefied includes a path of flow towards and through the said heat exchanger of the main refrigerant fluid circuit including, downstream of the said exchanger, an expansion member; a line bypassing the said path traversing the said heat-exchanger of the auxiliary refrigerant fluid circuit before connecting with the said flow path upstream of the said cryogenic exchanger of the main refrigerant fluid circuit.

According to another feature of the invention, the said auxiliary refrigerant fluid circuit including successively at least one compressor, at least one exchanger-cooler with a refrigerant fluid preferably of external origin; and the said cryogenic heat-exchanger being traversed by a path of flow of the auxiliary refrigerant fluid provided, at its outlet, with an expansion member, and by at least one path of flow, in countercurrent relationship, of the said refrigerant fluid after expansion, the said path of flow of the auxiliary refrigerant fluid in the said cryogenic exchanger has at least two, e.g. three, bypasses, provided with an expansion member, the portion of each bypass downstream of the said expansion member traversing the corresponding portion of the said cryogenic exchanger in substantially parallel and countercurrent relationship with the said path of flow.

According to another feature of the invention, a separator of the vapour and liquid phases is provided downstream of the said expansion member, the portion of the said bypass located downstream of the said separator being divided into a path of flow of the vapour phase and a path of flow of the liquid phase, the said path of flow of the vapour phase possibly not passing through the said exchanger.

The above-described method and apparatus offer a great number of advantages, such as for example:

- a remarkable flexibility allowing for very different operating conditions, e.g. a change in nature of the gas to be liquefied, while at the same time retaining a high thermodynamic efficiency, the said flexibility appearing both in the stage of processed design and the stage of operation of the liquefying unit;
- a particular suitability to the use of plate exchangers, resulting in moderate investment expenditure for the cryogenic exchange zone, combined with a modular design facilitating conveyance and layout, e.g. on a barge;
- a process design sufficiently capable of progressive modification to meet various particular needs, such as the warming up of the intakes of the compressor of the main cycle, intermediate treatments of the natural gas in course of liquefaction.

The flexibility of the method rests upon the following characteristics of the main refrigerant fluid:

- molar proportions of nitrogen, methane, propane and heavier hydrocarbons;
- molar proportions of vapour after partial condensation in the auxiliary refrigerating cycle;
- pressures of vapourization of the various fractions in the subcooled liquid state;
- distribution of each of the subcooled liquid fractions between the various pressure levels.

The invention will be better understood and other details, features and advantages of the latter will appear more clearly as the following explanatory description proceeds with reference to the appended diagrammatic drawings illustrating presently preferred forms of embodiment of the invention and wherein.

In the various appended drawings, identical reference numerals are used to designate identical or similar elements or parts, and the pressure values indicated by way of example are expressed in bars above atmospheric pressure.

Figure 1:
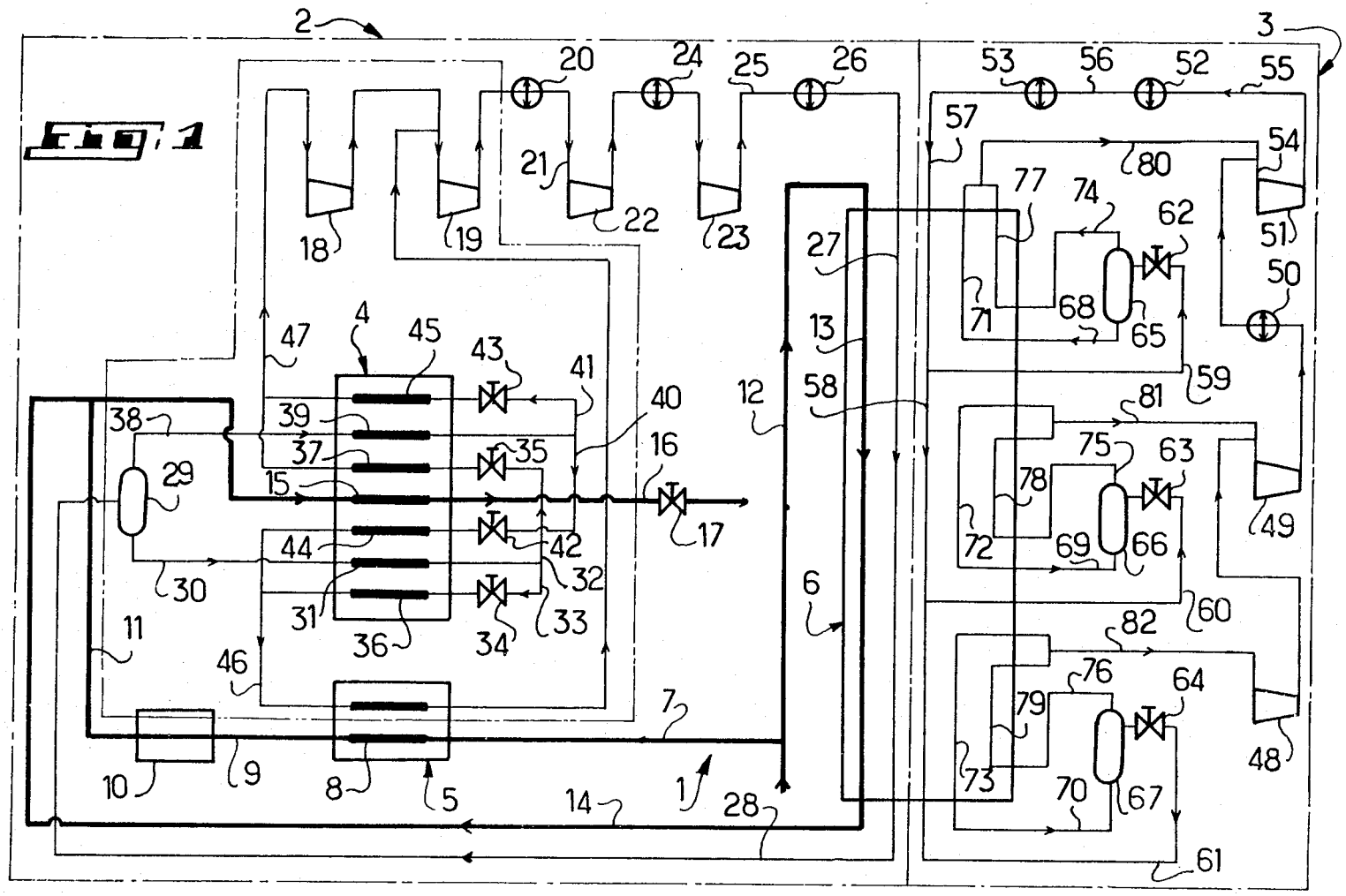
FIG. 1 is a schematic diagram of an apparatus for cooling and liquefying a gas with a low boiling point, such as for example natural gas, according to the invention.

Referring in particular to FIG. 1, the open circuit of the gas, e.g. the natural gas, to be liquefied, is designated generally by the reference numeral 1, whereas the closed circuit of main refrigerant fluid is designated generally by the reference numeral 2 and the closed circuit of auxiliary refrigerant fluid is designated by the reference numeral 3. The closed circuits of main and auxiliary refrigerant fluids are symbolically defined and contained within a rectangular frame in discontinuous, dash-dotted line, and the path of the gas to be liquefied is indicated by a continuous, full line. The circuit of gas to be liquefied 1 and the circuit of main refrigerant fluid 2 are thermally combined or interconnected through the medium of common cryogenic heat-exchangers for the liquefaction and subcooling, respectively, of the gas 4, on the one hand, and for preliminary cooling of the gas 5, on the other hand. The main and auxiliary refrigerant fluid circuits 2 and 3, respectively, are combined through the medium of at least one common cryogenic heat-exchanger 6 for the precooling and at least partial liquefaction of the main refrigerant fluid.

The open circuit 1 of gas to be liquefied includes a conduit 7 for feeding the gas to the precooling heat-exchanger 5 connected to at least one internal flow path 8 of the exchanger 5, the outlet of which is connected through a conduit 9 to an optional apparatus 10 for treating the gas, particularly for the extraction of ethane. Other gas treatment apparatuses may of course be provided; in particular, a nitrogen extracting apparatus may be provided for example in the region of the cryogenic heat-exchanger 4. The outlet of the apparatus 10 is connected by a conduit 11 to the inlet of the heat exchanger 4.

A conduit 12 bypassing the conduit 7 may be provided and connected to a path 13 of flow of a portion of the gas to be liquefied in the cryogenic heat-exchanger 6 of the auxiliary refrigerant fluid circuit, the outlet of which is connected by a flow path 14 to the conduit 11 before the inlet of the heat-exchanger 4. The conduit 11 is connected to an internal flow path 15 passing through the cryogenic heat-exchanger 4 and the downstream end of which is connected, at the outlet of the heat-exchanger 4, to a liquefied natural gas conduit 16 through at least one expansion member 17 such as for example an expansion valve.

The closed circuit 2 contains a main refrigerant fluid constituted by a mixture of several components, at least the greater part of which advantageously consists of hydrocarbons. The relative molar composition of this refrigerant fluid may be for example as follows:

nitrogen $N_2$: 0% to 2%
methane $CH_4$: 35% to 55%
ethylene $C_2H_4$ or ethane $C_2H_6$: 28% to 65%
propylene $C_3H_6$, propane $C_3H_8$: 0% to 15%.

The circuit 2 also includes successively (in the direction of flow of the refrigerant fluid): a first compressor 18 and a second compressor 19 for the fluid refrigerant in the gaseous state, which are driven either each separately by an individual driving machine or together jointly by a common driving machine; in the latter case, their respective shafts are coupled together mechanically. The two compressors 18,19 are connected in series with an exchanger-cooler 20 the cooling fluid of which is advantageously of external origin and constituted for example by water or air. The compressors 21,22 may be driven jointly, or jointly with at least one of the compressors 18,19, or each separately. The outlet of the exchanger-cooler 20 is connected by a conduit 21 to a third compressor 22 and a fourth compressor 23 connected in series through at least one intermediate cooler 24 whose cooling fluid is advantageously of external origin and constituted for example by water or air. The outlet and discharge orifice of the compressor 23 is connected by a conduit 25, through an exchanger-cooler 26 (whose cooling fluid is advantageously of external origin, such as for example water or air), to the inlet of the heat exchanger 6 and more precisely to the upstream end of at least one internal flow path extending within the latter. The cryogenic heat-exchanger 6 of the auxiliary refrigerant fluid circuit consists advantageously of a plate exchanger. At the outlet of the heat exchanger 6, the downstream end of the flow path 27 is connected by a conduit 28 to at least one phase separator 29. The liquid collecting space of this phase separator is connected by a conduit 30 to the inlet of the heat-exchanger 4 and more precisely to the upstream end of at least one flow path 31 extending within the heat-exchanger 4 in substantially the same direction as the internal path 15 of flow of the gas to be liquefied. The downstream end of the internal flow path 31 divides, after the outlet of the heat-exchanger 4, into two flow paths 33,32, respectively, connected to the inlet of expansion members 34,35, respectively. At the outlet of each expansion member 34,35 is connected a flow path 36,37 extending within the cryogenic heat exchanger 4 in substantially the same direction as the internal path 15 of flow of the gas to be liquefied and to the flow path 31, and in countercurrent relationship.

The vapour-collecting space of the phase separator 29 is connected by a conduit 38 to the inlet of the cryogenic heat-exchanger 4 and more precisely to the upstream end of at least one other internal flow path 39 extending in substantially parallel relationship with the flow paths 15 and 31. The downstream end of the flow path 39 divides, after the outlet of the heat-exchanger 4, into two flow paths 40,41 connected to the inlet of the expansion members 42,43, respectively, the outlet of the expansion members 42,43 is connected to flow paths 44,45, respectively, extending within the cryogenic heat-exchanger 4 in substantially the same direction as the other flow paths 15,31,36,37 and 39.

According to the invention, the cryogenic heat-exchanger 4 of the main refrigerant fluid conduit 2 is a plate exchanger provided, as has been seen above, with different passage paths for each of the fluids present during the thermal exchange, namely, the gas to be liquefied, the liquid and vapour phases or fractions of the partially condensed main refrigerant fluid, as well as the fractions issued therefrom, expanded to different pressure levels.

After the outlet of the cryogenic exchanger 4, the paths 36 and 44 of flow of the main refrigerant fluid fractions expanded to a same pressure, e.g. a medium pressure ranging for example from about 1.5 to 3 bars, connect with one another into a single flow path 46 which may possibly be passed through the heat exchanger 5 for precooling the gas to be liquefied, particularly in countercurrent relationship therewith, the downstream end of the flow path 46 being connected to the intake orifice of the compressor 19. Likewise, after the outlet of the cryogenic heat-exchanger 4, the paths 37 and 45 of flow of the fractions of main refrigerant fluid expanded to a same pressure, particularly to a low pressure, e.g. lower than about 1 bar above atmospheric, connected together into a single flow path 47 the downstream end of which opens into the intake orifice of the compressor 18.

The circuit 3 contains an auxiliary refrigerant fluid constituted by a mixture preferably based only on hydrocarbon, having for example the following relative molar composition:

ethylene $C_2H_4$ or ethane $C_2H_6$: 30% to 70%
propylene $C_3H_6$ or propane $C_3H_8$: 70% to 30%

The closed circuit 3 of auxiliary refrigerant fluid includes successively the following elements (in the direction of flow of the fluid): first, second and third compressors 48,49,51, respectively, connected in series with one another and driven either by respective individual driving machines, or by at least one driving machine common to at least two compressors which, in this case, are directly coupled together mechanically by their respective shafts. The outlet or discharge orifice of the second compressor 49 is connected to the inlet or intake orifice of the third compressor 51 by a conduit 54 through an exchanger-cooler 50 with a cooling agent preferably of external origin such as for example water or air. The outlet or discharge orifice of the third compressor 51 is connected by a conduit 55 with a condensor 52, the outlet of which is connected by a conduit 56 to a subcooler 53.

The outlet of the subcooler 53 is connected by a conduit 57 to the cryogenic heat-exchanger 6, which may be constituted particularly by a plate exchanger, and more particularly to the upstream end of a flow path 58 passing through the heat-exchanger 6 in a direction substantially parallel with the paths 13 and 27 of flow of the gas to be liquefied and of the main refrigerant fluid, respectively.

The path 58 of flow of the auxiliary refrigerant fluid in the cryogenic heat-exchanger 6 has for example three bypasses 59,60 and 61 provided at three different levels in the exchanger 6. The three bypasses 59,60 and 61 are each connected to an expansion member 62,63 and 64, respectively, the outlet of which is connected to a separator of the vapour and liquid phases 65,66 and 67, respectively. In all three cases, the liquid-collecting space of the phase separators 65,66 and 67 is connected by a conduit 68,69 and 70, respectively, to an inlet of the cryogenic heat-exchanger 6 and more precisely to the upstream end of a flow path 71,72 and 73, respectively, the greater part of which extends within the cryogenic heat-exchanger 6 in a direction at least approximately parallel with the paths 13, 27 and 58 of flow of the gas to be liquefied, of the main refrigerant fluid and of the auxiliary refrigerant fluid before expansion, respectively. Likewise, the vapour-collecting spaces of each phase separator 65,66,67 are connected by a conduit 74, 75 and 76, respectively, to an inlet of a cryogenic heat-exchanger 6 and more particularly to the upstream end of a flow path 77, 78, 79, the greater portion of which extends within the cryogenic heat-exchanger 6 in substantially the same direction as the other internal flow paths 13, 27 and 58. After leaving the exchanger 6, the flow paths 71 and 77, 72 and 78, 73 and 79, respectively, connect with one another into a single flow path 80, 81 and 82, respectively. The flow path 82 is connected to the intake orifice of the compressor 48, the flow path 81 is connected to the intake orifice of the compressor 49 and the flow path 80 is connected to the intake orifice of the compressor 51.

The circuit 1 operates as follows. The gas to be liquefied, e.g. natural gas, arriving through the conduit 7 at a temperature of for example about +20° C. and a pressure of for example about 42.5 bars, flows through the passage path 8 of the heat-exchanger 5 and is precooled therein by heat-exchange with the main refrigerant fluid vaporized after expansion in the cryogenic heat exchanger 4 and circulating through the flow path 46 in the contrary direction to the direction of flow of the gas in the passage path 8. The gas leaving the heat-exchanger 5 through the conduit 9 is at a temperature of for example about −45° C. and at a pressure of for example about 42 bars. It thereafter passes through the treatment apparatus 10 and reaches through the conduit 11 the inlet of the flow path 15 in the plate exchanger 4 where it is entirely liquefied and then subcooled by heat exchange with the main refrigerant fluid. The liquefied gas leaving the heat-exchanger 4 is at a temperature of for example about −154° C. and at a pressure of for example about 41.5 bars. It is thereafter expanded in the expansion valve 17 and then conveyed to the place of storage of the liquefied natural gas or to a place of treatment for use thereof.

Part of the gas to be liquefied may also be precooled by heat exchange with the auxiliary refrigerant fluid in the cryogenic heat-exchanger 6, the said portion being thereafter combined with the rest of the gas to be liquefied before its entry into cryogenic heat-exchanger 4.

The main refrigerant fluid circuit 2 operates as follows. The portion of main refrigerant fluid expanded to a low pressure is sucked in the gaseous state, at a temperature of for example about −52° C. and a pressure of for example about 0.08 bar by the first compressor 18 from which it is discharged at a medium pressure of for example about 2 bars and at a temperature of for example about 10° C., and is thereafter sucked by the second compressor 19 at the same time as the main refrigerant fluid portion expanded to a medium pressure equal for example to about 2 bars and whose temperature is for example about 10° C. The whole is delivered by the compressor 19 at a temperature equal for example to about 71° C. and at a pressure equal for example to about 6.5 bars, and it then passes through the exchanger-cooler 20 in which the temperature of the main refrigerant fluid is lowered for example to about 15° C. It then enters through the flow path 21 the intake orifice of the compressor 22, passes through the exchanger-cooler 24 whereafter it is compressed in the compressor 23 and then passes through the flow path 25 and the heat exchanger 26. The main refrigerant fluid leaving the heat exchanger 26 is for example at a temperature of about 15° C. and a pressure of about 27.4 bars. It then enters the flow path 27 of the cryogenic heat-exchanger 6 where the main refrigerant fluid is cooled by heat exchange with the auxiliary refrigerant fluid and is thus at least partially liquefied. The main refrigerant fluid thus at least partially condensed at a temperature of for example about −50° C. and a pressure of for example about 26.5 bars then leaves the heat-exchanger 6 in the form of a mixture of gaseous phase and liquid phase which are thereafter separated in the phase separator 29. The gaseous phase is conveyed through the conduit 38 into the segments of the flow path 39 which is located in the cryogenic heat exchanger 4 to be liquefied and then subcooled therein to a temperature of for example about −154° C. A portion of this liquefied and subcooled gaseous phase flows through the path 41 and is expanded in the expansion member 43 to a pressure of for example about 0.3 bar, its temperature being for example about −156° C. At the outlet of the path 45 of flow of this fraction of liquefied and subcooled gaseous phase, the temperature and pressure conditions are for example about −52° C. and about 0.08 bar, respectively. The other portion of the liquefied and subcooled gaseous phase flows through the path 40 and is expanded in the expansion member 42 to a pressure of for example about 2.3 bars, its temperature being about −153° C. At the outlet of path 44 of flow of this fraction in the exchanger 4, the temperature and pressure conditions are for example as follows: −152° C. and 2.10 bars.

Likewise, the liquid phase of the main refrigerant fluid proceeding from the phase separator 29 is conveyed by the conduit 30 into the flow path 31 of the cryogenic heat-exchanger 4 to be subcooled therein to a temperature of for example about −154° C., at a pressure of for example about 26 bars. A portion of the subcooled liquid phase of the main refrigerant fluid passes through the expansion member 35 where its pressure is reduced for example to about 0.3 bar, whereas another portion of the subcooled liquid phase flowing through the path 33 is expanded in the expansion member 34 to a pressure of about 2.3 bars, its temperature being for example about −153° C. After flowing through the paths 37 and 36, respectively, the said first and second portions of liquid phase of the main refrigerant fluid present the following temperature and pressure conditions: −52° C. and 0.08 bar, and −52° C. and 2.10 bars, respectively.

Thus, according to the invention, a first portion of the vapour phase of the main refrigerant fluid, after being condensed and subcooled, is expanded to a first pressure, and a second portion is expanded to a second pressure; on the other hand, a first portion of the said liquid phase of the main refrigerant fluid, after being subcooled, is expanded to the said first pressure, a second portion being expanded to the said second pressure. Quite obviously, the vapour and liquid phases may be divided into the desired number of portions, e.g. three or more, the pressure to which a portion of the liquid phase is expanded corresponding to the pressure to which a corresponding portion of the vapour phase is expanded.

After the vaporization, the first portions of the vapour and liquid phases are mixed, and the second portion of the said vapour and liquid phases are mixed.

Figure 5:
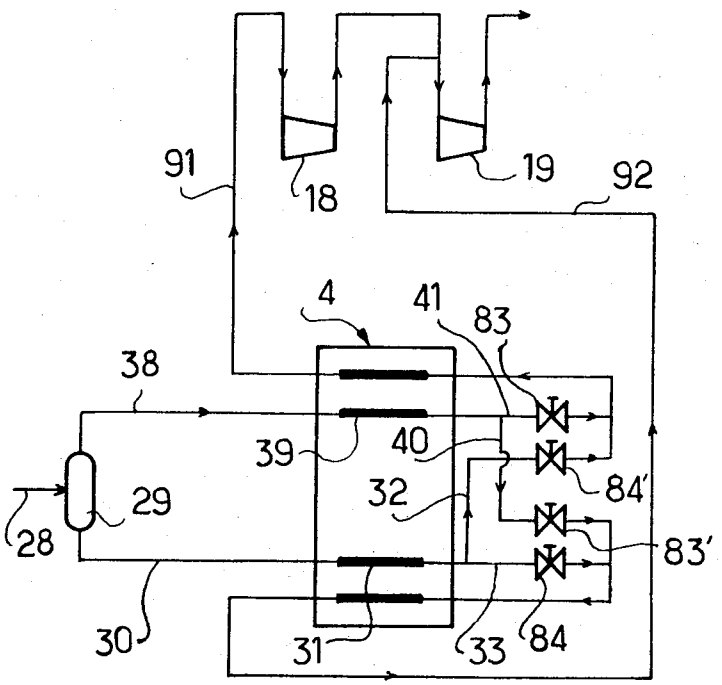
FIG. 5 is a diagrammatic view of another form of embodiment of the apparatus of the invention.

There is also another possibility, consisting in mixing the first portions of the vapour and liquid phases and in mixing the second portions of the vapour and liquid phases after expansion, but before vaporization (form of embodiment illustrated in FIG. 5).

Lastly, the portion of main refrigerant fluid vapourized at low pressure is admitted through the flow path 47 into the intake orifice of the compressor 18, whereas the portion of main refrigerant fluid vapourized at a medium pressure is admitted through the flow path 46, possibly after having passed through the heat exchanger 5 for the precooling of the gas to be liquefied, into the intake orifice of the compressor 19.

The operation of the auxiliary refrigerant fluid circuit 3 is as follows. The auxiliary refrigerant fluid in the gaseous state leaving the set of compressors 48, 49, 51 is, for example, at a temperature of about +46° C. and at a pressure of for example about 16 bars. After passing through the cooling exchangers 52 and 53, the auxiliary refrigerant fluid is at a temperature of about +13° C., whereas its pressure is about 15.1 bars. The auxiliary refrigerant fluid portion bypassed through the flow path 59 is at a temperature of for example about 0° C. and a pressure of for example about 15 bars. After expansion in the expansion member 62, the temperature is reduced for example to about −6.5° C. and the pressure for example to about 8.5 bars. The vapour and liquid phases thus obtained, separated by the phase separator 65, then flow in the cryogenic heat-exchanger 6 through the flow paths 77 and 71, respectively, in heat exchange relationship with the fluids contained in the other flow paths 13, 27 and 58 flowing through the heat exchanger 6. The said vapour and liquid phases being mixed after their exit from the exchanger 6, the temperature and pressure conditions of the auxiliary refrigerant fluid are then as follows: for example about 11° C. and for example about 8.5 bars. The auxiliary refrigerant fluid portion is conveyed to the intake orifice of the compressor 51 through the flow paths 80 and 54.

The temperature and pressure conditions of the second portion of the auxiliary refrigerant fluid flowing through the bypass 60 are as follows: for example about −25° C. and for example about 14.5 bars. After expansion in the expansion member 63, the temperature is reduced for example to about −28° C. and the pressure for example to about 4 bars. The liquid and vapour phases thus obtained pass through the flow paths 78 and 72, respectively, in the exchanger 6 so as to take part in the thermal exchange with the other fluids flowing in this exchanger, and then connect with one another into the flow path 81 upon leaving the said exchanger. The temperature and pressure conditions of this portion of auxiliary refrigerant fluid are then as follows: for example about −3° C. and for example about 3.9 bars. This portion of the auxiliary refrigerant fluid is introduced into the intake orifice of the compressor 49.

Likewise, a third portion of the auxiliary refrigerant fluid flows through the flow path 61 at a temperature of for example about −50° C. and a pressure of for example about 14.2 bars. After the expansion in the expansion member 64, these temperature and pressure conditions change as follows: for example about −54° C. and for example about 1.1 bar. The vapour and liquid phases thus obtained are separated in the phase separator 67 and then flow through the flow paths 73 and 79 into the heat-exchanger 6 to take part in the thermal exchange with the other fluids flowing therein. These vapour and liquid phases, after connecting with one another on leaving the exchanger 6, are at a temperature of for example about −28° C. and a pressure of for example about 0.90 bar. This third portion of the auxiliary refrigerant fluid is introduced into the intake orifice of the compressor 48 through the flow path 82.

Figure 2:
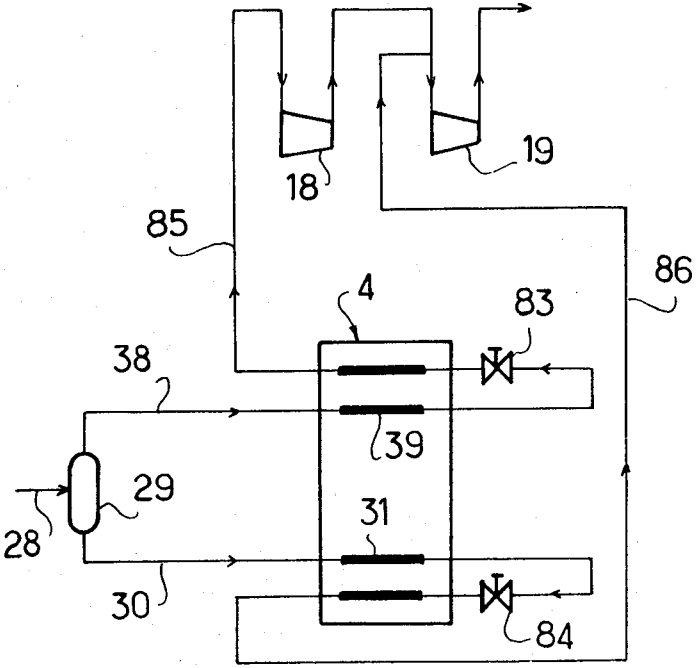
FIG. 2 is a diagrammetic view of a first form of embodiment of the cryogenic exchanger of the main refrigerant fluid circuit according to the invention.

In FIG. 2, illustrating a modified form of embodiment of the apparatus of the invention, there is shown only a portion of the latter, framed in chain-dotted line in FIG. 1, the rest of the apparatus being identical.

In this form of embodiment, the whole of the vapour phase of the main refrigerant fluid, condensed and subcooled in the exchanger 4 is expanded at once in the expansion member 83 to a first pressure. The whole of the liquid phase of the main refrigerant fluid, subcooled in the exchanger 4 is expanded at once to a second pressure different from the said first pressure in the expansion member 84. The vapour phase expanded for example to a low pressure of less than about 1 bar above atmospheric is conveyed through the heat-exchanger 4 and the flow path 85 to the intake orifice of the first compressor 18, whereas the liquid phase of the main refrigerant fluid, expanded to a medium pressure, in particular ranging from about 1.5 to about 3 bars, is conveyed through the exchanger 4 and the flow path 86 to the intake orifice of the second compressor 19. It should be noted that the general operation of the apparatus for cooling and liquefying a gas with a low boiling point, such as for example natural gas, according to the form of embodiment of FIG. 2, is similar to that of the apparatus according to FIG. 1.

Figure 3:
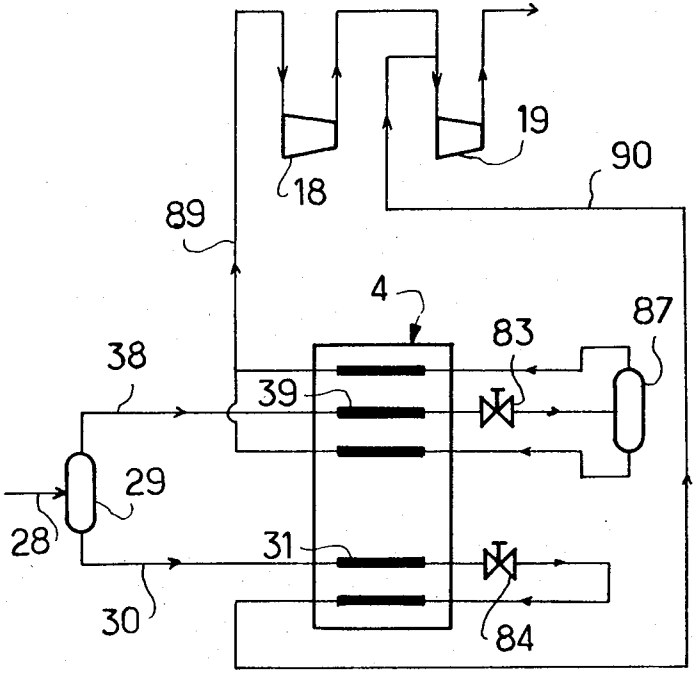
FIG. 3 is a diagrammatic view of a second form of embodiment of the cryogenic exchanger of the main refrigerant fluid circuit.

Reference is now made to FIG. 3 illustrating another form of embodiment of the same portion (indicated by a frame in chain-dotted line in FIG. 1) of the apparatus as that of FIG. 2. In this case, after the expansion of the vapour phase condensed and subcooled in the expansion member 83, the gaseous and liquid phases thus obtained are separated in a phase separator 87 before being passed again, in countercurrent relationship therewith, through the cryogenic heat-exchanger 4. After the vaporization, the two phases connect with one another into the same flow path 89 connected to the intake orifice of the compressor 18; therefore, in this case, the vapour phase is expanded to the aforesaid low pressure.

The subcooled liquid phase of the main refrigerant fluid is expanded in the expansion member 84 and circulates in countercurrent relationship therewith in the exchanger 4, to the outlet of which is connected the flow path 90, itself connected to the intake orifice of the compressor 19.

The vapour phase leaving the separator 87 may also not be repassed through the exchanger 4 but introduced directly into the conduit 89.

Figure 6:
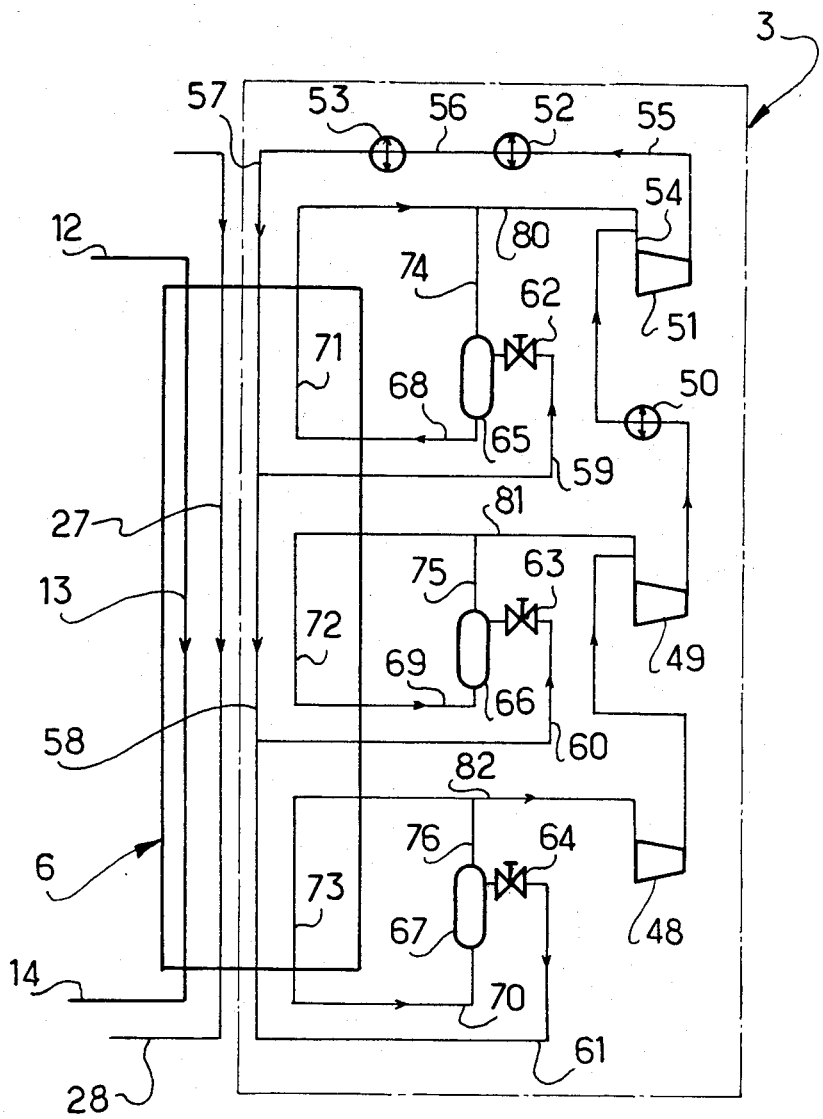
FIG. 6 is a diagrammatic view of one form of embodiment of the auxiliary refrigerating circuit.

FIG. 6 illustrates the application of this form of embodiment to the auxiliary refrigerating circuit. In this case, the conduits 74, 75, 76 departing from the vapour-collecting space of the separators 65, 66, 67 are connected directly to the flow paths 80, 81, 82 without passing through the exchanger 6.

Figure 4:
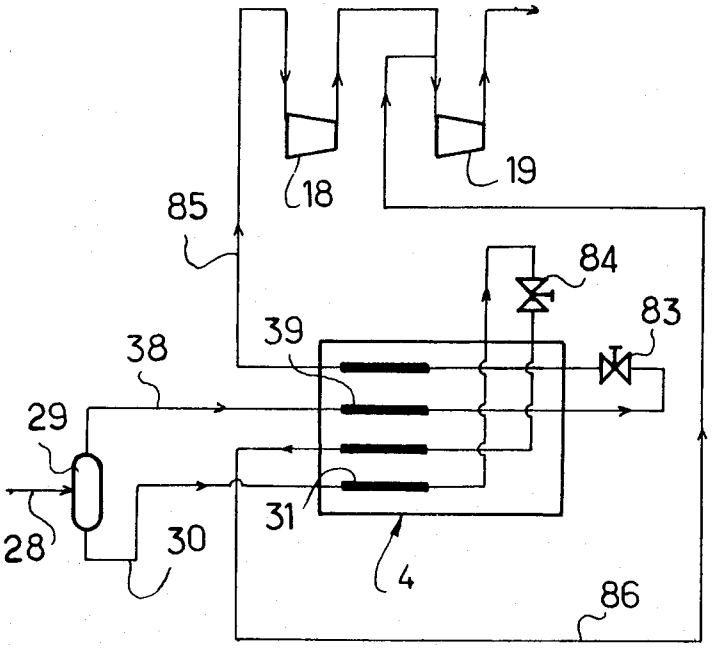
FIG. 4 is a diagrammatic view of a third form of embodiment of the cryogenic exchanger of the main refrigerant fluid circuit.

FIG. 4 is a view of a modified form of of embodiment of the apparatus portion framed in interrupted line in FIG. 1, similar to the form of embodiment illustrated in FIG. 2. In this case, each element of the expansion system 83, 84, instead of being located at the outlet of the exchanger 4, may be situated, with respect to the cryogenic heat-exchanger 4 of the main refrigerant fluid circuit 2, at any location, along the exchanger 4, in the direction of flow of the various fluids. Thus, as in the example illustrated, the path 31 of flow of the liquid phase of the main refrigerant fluid does not pass through the whole of the exchanger 4. This allows performing the expansion to different temperature levels, in case, after the valve, the temperature should be higher. The displacement of the expansion according to a temperature gradient corresponds to a displacement of the expansion member along the exchanger, in the direction of flow of the fluids.

Lastly, as mentioned above, FIG. 5 illustrates a modified form of embodiment wherein the first portions of the vapour and liquid phases are mixed and the second portions of the said vapour and liquid phases are mixed, after expansion, in the valves 83, 84'; 83', 84, respectively, but before countercurrent recirculation, in the exchanger 4.

There is given hereafter an example of cooling and liquefaction of a natural gas available under the following conditions:

temperature: 20° C.
pressure: 42.44 bars above atmospheric
mass rate of flow: 239,908 kg/h
chemical composition in molar proportions:
$N_2$: 0.36
$C_1$: 93.06
$C_2$: 4.08
$C_3$: 1.67
$C_4$: 0.83

Upstream of the final expansion device, the liquefied gas is obtained under the following conditions:

temperature: 153.7° C.
pressure: 41.44 bars above atmospheric
mass rate of flow and molar composition identical with the foregoing values.

An example of design of the process of the invention leads to the following results by way of example.

MAIN REFRIGERATION CYCLE

Molar composition:
$C_1$: 40%
$C_2$: 50%
$C_3$: 10%
molar proportion vaporized in the phase separator 29: 20%.

The distribution of the liquid and subcooled fractions of the main refrigerant between the two pressure levels are defined as follows:

$$R_1 = \frac{\text{molar rate of flow of the main refrigerant in the passage 37}}{\text{molar rate of flow of the main refrigerant in the passage 31}}$$

$$R_2 = \frac{\text{molar rate of flow of the main refrigerant in the passage 44}}{\text{molar rate of flow of the main refrigerant in the passage 39 of the exchanger 4}}$$

$R_1 = 0.50$ and $R_2 = 0.37$
Mass rate of flow: 408,563 kg/h
Compressors:
Intake pressure of the compressor 18: 0.03 bar
Intake pressure of the compressor 19: 1.95 bar

| | Compressors 18, 19 | Compressors 22, 23 | Total |
|---|---|---|---|
| Power, kW | 19,256 | 19,516 | 38,772 |

Exchanger:

Ratio of quantities of heat exchanged at medium or mean approaches in temperature:

67,841,400×$10^3$ joules/h°C. for exchanger 4.

AUXILIARY REFRIGERATION CYCLE

Molar composition of the auxiliary refrigerant:

$C_2$: 40%

$C_3$: 60%

Mass rate of flow: 600,972 kg/h.

Compressors:

Power of compressors 48, 49, 51: 17,021 kW.

What is claimed is:

1. A method of cooling and liquefying at least one gas having a low boiling point through heat exchange with at least one part of a main refrigerating fluid precooled until its at least partial liquefaction through heat exchange with an auxiliary refrigerating fluid, said refrigerating fluids being part of an incorporated cold-generating cascade of at least these two refrigerating fluids, each refrigerating fluid consisting of a mixture of several component substances, and said main refrigerating fluid evolving according to a closed-loop cooling cycle while successively undergoing therein: at least one compression in the gaseous state, at least one preliminary cooling with at least partial condensation, through heat exchange with said auxiliary refrigerating fluid, at least one separation of the liquid and vapor phases thus obtained, at least one refrigeration with total liquefaction and then sub-cooling and thereafter expansion through subsequent heat exchange and resulting attendant vaporization, in countercurrent relationship with itself and with the said gas for liquefying the latter at least partially, its vapor thus reheated being finally recycled and recompressed, wherein the improvement consists in the steps of once expanding said condensed and sub-cooled vapor phase of the main refrigerating liquid down to at least one first pressure, and of once expanding the said sub-cooled liquid phase of the main refrigerating fluid down to at least one second pressure, different from the said first pressure.

2. A method according to claim 1, which comprises expanding a first and second portion of the said condensed and sub-cooled vapor phase of the main refrigerating fluid to a first and second pressure respectively, and expanding a first and second portion of the said sub-cooled liquid phase of the main refrigerating fluid to said first and second pressures respectively.

3. A method according to claim 2, which further comprises the steps of mixing said first portions of said vapor and liquid phases respectively and mixing said second portions of said vapor and liquid phases respectively, after said vaporization has occurred (FIG. 1).

4. A method according to claim 2, which comprises the steps of mixing said first portions of said vapor and liquid phases, and mixing said second portions of said vapor and liquid phases, after said expansion before said vaporization (FIG. 5).

5. A method according to claim 1, which comprises the steps of separating the vapor and liquid phases of the vapor phase of the main refrigerating fluid, obtained after the said expansion, prior to heat exchange with the said gas to be liquefied and the main refrigerating fluid prior to expansion (FIG. 3).

6. A method according to claim 1, wherein said first pressure is a low pressure less than about 1 bar above atmospheric and said second pressure is a medium pressure ranging from about 1.5 bar above atmospheric to about 3 bars above atmospheric.

7. A method according to claim 1, which further comprises the step of pre-cooling at least a portion of the said gas to be liquefied through heat exchange with at least a portion of said auxiliary refrigerating fluid.

8. A method according to claim 1, which further comprises the steps of pre-cooling at least a portion of said gas to be liquefied through heat exchange with at least a portion of said reheated vapor at said first or said second pressure.

9. A method according to claim 1, which comprises the step of pre-cooling at least a portion of said main refrigerating fluid through heat exchange with at least a portion of said reheated vapor at said first or said second pressure.

10. A method according to claim 1, wherein the said auxiliary refrigerating fluid evolves according to a closed-loop cooling cycle while successively undergoing therein: at least one compression in the gaseous state; at least one preliminary cooling with possible at least partial condensation through heat exchange with a cooling medium; at least one self-refrigeration with total liquefaction and then sub-cooling and thereafter expansion through subsequent heat exchange and resulting attendant vaporization in counter-current relationship with itself before its expansion and with the main refrigerating fluid and the gas to be liquefied, the vapor thus reheated being recycled and recompressed, said method comprising the step of expanding the auxiliary refrigerating fluid, prior to vaporization down to at least two pressure levels.

11. A method according to claim 10, wherein the vapor and liquid phases of the auxiliary refrigerating fluid obtained after expansion are separated.

12. A method according to claim 1, wherein said main refrigerating fluid has the following molar composition:

nitrogen $N_2$: 0% to 2% methane $CH_4$: 35% to 55% ethylene $C_2H_4$ or ethane $C_2H_6$: 28% to 65% propylene $C_3H_6$ or propane $C_3H_8$: 0% to 15%.

13. A method according to claim 1, wherein said auxiliary refrigerant fluid has the following molar composition:

ethylene $C_2H_4$ or ethane $C_2H_6$: 30% to 70% propylene $C_3H_6$ or propane $C_3H_8$: 70% to 30%.

14. An apparatus for cooling and liquefying at least one gas having a low boiling point, including at least the following circuits:

an open circuit of gas to be liquefied (1);

a closed circuit of main refrigerating fluid (2) in heat exchanging relationship with said gas circuit (1) by means of at least one cryogenic heat-exchanger (4), and being part of one cold-generating incorporated cascade of at least two refrigerating main and auxiliary fluids, respectively;

a closed circuit of auxiliary refrigerating fluid (3) in heat exchanging relationship with said circuit of main refrigerating fluid (2) and said circuit of gas to be liquefied (1), by means of at least one cryogenic heat-exchanger (6) for pre-cooling and at least partially liquefying said main refrigerating fluid, the said closed circuit of main refrigerating fluid (2) successively comprising at least the following elements: at least one gaseous fluid compressor (18, 19, 22, 23); at least one heat exchanger or cooler (20, 24, 26); a flow passage-way (27) for the main refrigerating fluid extending through the said cryogenic exchanger (6) of the auxiliary refrigerating fluid circuit (3); a separator (29) for separating the vapor and liquid phase of said main refrigerating fluid; said cryogenic heat-exchanger (4); and expansion means (34, 35, 42, 43, 83, 84) including an expansion member provided on the flow passage-way of each fraction of the main refrigerating fluid and connected to said compressor, the improvement consisting in that the said cryogenic heat-exchanger (4) or the main refrigerating fluid circuit (2) is a plate exchanger provided with multiple passage-ways (15, 31, 36, 37, 39, 44, 45) for each of the fluids present during the heat exchange, namely, the gas to be liquefied, the liquid and vapor phases or fractions of the partially condensed main refrigerating fluid, as well as the fractions derived therefrom, expanded to different pressure levels.

15. An apparatus according to claim 14, wherein the location of each element of the said expansion means with respect to the said cryogenic heat-exchanger (4) of the main refrigerating fluid circuit (2) is modifiable for each said fraction of the main refrigerating fluid.

16. An apparatus according to claim 14, which comprises a separator (87) of the vapor and liquid phases, downstream of the said expansion member (83), in the path of flow of the vapor fraction of the main refrigerating fluid.

17. An apparatus according to claim 14, which comprises a heat-exchanger (5), upstream of said cryogenic heat-exchanger (4) of the main refrigerating fluid circuit (2), traversed on the one hand by the main refrigerating fluid vaporized after expansion in the said cryogenic heat-exchanger (4) and, on the other hand, by at least a portion of the gas to be liquefied.

18. An apparatus according to claim 14, wherein the said circuit of gas to be liquefied (1) includes: a flow passage-way (7, 9, 11) towards and through the said heat-exchanger (4) of the main refrigerating fluid circuit (2), and is provided, downstream of the said exchanger, with an expansion member (17); a conduit (12, 13, 14) bypassing the said passage-way and extending through the said heat-exchanger (6) of the auxiliary refrigerating fluid circuit (3) before connecting with the said passage-way upstream of the said cryogenic heat-exchanger (4) of the main refrigerating fluid circuit (2).

19. An apparatus according to claim 14, wherein the said auxiliary refrigerating fluid circuit (3) comprises successively: at least one compressor (48, 49, 51); at least one exchanger-cooler (50, 52, 53) with a refrigerating fluid of outer origin; and said cryogenic heat-exchanger (6) being traversed by a flow passage-way (58) for said auxiliary refrigerating fluid; and said passage-way (58) has three bypasses (59, 60, 61), each provided with an expansion member (62, 63, 64), the portion of each bypass downstream of the said expansion member passing through the corresponding portion of the said cryogenic exchanger (6) in substantially parallel relationship with the said flow passage-way, and in countercurrent relationship therewith.

20. An apparatus according to claim 19, wherein a separator of the vapor and liquid phases (65, 66, 67) is provided downstream of said each expansion member (62, 63, 64), and the portion of each bypass located downstream of the said separator is divided into a flow passage-way for the liquid phase (68, 71; 69, 72; 70, 73).

21. An apparatus according to claim 20, wherein the said passage-ways (68, 71; 69, 72; 70, 73) for the liquid phase extend through said cryogenic exchanger (6) before connecting with said passage-ways (74, 75, 76) for the vapor phase after these latter have passed through the said exchanger (6).

* * * * *